US008532965B2

(12) United States Patent
Hirata et al.

(10) Patent No.: US 8,532,965 B2
(45) Date of Patent: Sep. 10, 2013

(54) METHOD AND SYSTEM FOR TRAFFIC SIMULATION OF ROAD NETWORK

(75) Inventors: Yosuke Hirata, Kamakura (JP); Hideki Ueno, Urayasu (JP); Yoshikazu Ooba, Hachioji (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 405 days.

(21) Appl. No.: 12/509,025

(22) Filed: Jul. 24, 2009

(65) Prior Publication Data

US 2010/0070253 A1 Mar. 18, 2010

(30) Foreign Application Priority Data

Sep. 12, 2008 (JP) ..... 2008-235139

(51) Int. Cl.
*G06G 7/48* (2006.01)
*G06G 7/70* (2006.01)

(52) U.S. Cl.
USPC ..... 703/6; 701/119; 703/8

(58) Field of Classification Search
USPC ..... 703/6, 8; 701/1, 117, 118, 119
See application file for complete search history.

(56) References Cited

U.S. PATENT DOCUMENTS

| | | | | |
|---|---|---|---|---|
| 5,801,943 | A * | 9/1998 | Nasburg | 701/117 |
| 6,317,686 | B1 * | 11/2001 | Ran | 701/533 |
| 2007/0052701 | A1 | 3/2007 | Trotta et al. | |
| 2007/0093997 | A1 * | 4/2007 | Yang et al. | 703/8 |
| 2008/0319639 | A1 * | 12/2008 | Yamane | 701/118 |

FOREIGN PATENT DOCUMENTS

| | | |
|---|---|---|
| DE | 10 2004 009 085 | 1/2005 |
| JP | 05-28394 | 2/1993 |
| JP | 10-105054 | 4/1998 |
| JP | 11-232583 | 8/1999 |
| JP | 2004-078482 | 3/2004 |
| JP | 2004-258889 | 9/2004 |
| JP | 2005-084722 | 3/2005 |
| JP | 2007-034349 | 2/2007 |
| JP | 2007-041782 | 2/2007 |
| JP | 2008-059181 | 3/2008 |

OTHER PUBLICATIONS

Tactical-level Simulation for Intelligent Transportation Systems, 1998; pp. 1-19.*

Notification of Reasons for Rejection issued from the Japanese Patent Office for corresponding Japanese Application No. 2008-235139, mailed Jul. 28, 2010, 2 pages.

(Continued)

*Primary Examiner* — Kamini S Shah
*Assistant Examiner* — Andre Pierre Louis
(74) *Attorney, Agent, or Firm* — Finnegan, Henderson, Farabow, Garrett & Dunner, LLP

(57) ABSTRACT

According to one embodiment, a system is disclosed, which uses road parameters defining the road network and model parameters used as initial-value parameters, thereby performing traffic simulation by the microsimulation method. The system includes a traffic simulator and a display controller. The traffic simulator performs traffic simulation to predict a traffic condition on an object road of a road network. The display controller controls a display unit, displaying the result of the simulation. More precisely, the display controller displays a dynamic image showing the traffic condition of vehicles running on the road network, on the screen of the display unit, and changes the image in terms of pattern, in accordance with a display instruction.

9 Claims, 9 Drawing Sheets

(56) References Cited

OTHER PUBLICATIONS

Search Report issued from the European Patent Office for counterpart European Application No. 09166306.2-1232, dated Mar. 8, 2010, 7 pages.

Sukthankar, J. et al. "Tactical-level simulation for intelligent transportation systems," Mathematical and Computer Modelling, vol. 27, No. 9-11, May 1998, pp. 229-242.

Fotherby, T. "VISSIM project background", Oct. 16, 2005. Retrieved from the Internet: http://www.tomfotherby.com/Websites/VISSIM/outBack.html (XP002567552), 6 pages.

Treiber, M.: "Microsimulation of road traffic" May 7, 2008. Retrieved from the Internet: http://www.traffic-simulation.de/ (XP002567553), 4 pages.

Sukthankar, R. et al. "SHIVA: Simulated Highways for Intelligent Vehicle Algorithms," Intelligent Vehicles '95 Symposium., Proceedings of the Detroit, MI, 25-26, Sep. 25, 1995, pp. 332-337.

"Easy Traffic Simulation", Japan Society of Traffic Engineering, Maruzen Co., Ltd., ISBN 4-905990-31-9C3051, pp. 120-151, Jun. 2006.

* cited by examiner

METHOD AND SYSTEM FOR TRAFFIC SIMULATION OF ROAD NETWORK

CROSS-REFERENCE TO RELATED APPLICATIONS

This application is based upon and claims the benefit of priority from prior Japanese Patent Application No. 2008-235139, filed Sep. 12, 2008, the entire contents of which are incorporated herein by reference.

BACKGROUND OF THE INVENTION

1. Field of the Invention

The present invention relates to a technique of simulating the condition of traffic in a road network.

2. Description of the Related Art

Road traffic control systems are designed, generally for controlling the traffic in accordance with the actual traffic of many vehicles running on the roads. In any road network, the roads and traffic facilities must be changed or new roads and new facilities must be built, in order to eliminate traffic congestion or to ensure a smooth traffic flow on a road. However, traffic congestion may occur on other roads or the traffic flow on other roads may become less smooth.

In view of this, the traffic control plan must be verified or quantitatively evaluated for its effect. The traffic simulation technique is therefore very important. Since traffic simulation evaluates the traffic control and predicts the traffic conditions on various roads, it can help to plan an effective traffic control system.

Traffic simulation methods are classified into two types, i.e., macrosimulation method and microsimulation method. In the macrosimulation method, the traffic of vehicles is regarded as a continuous fluid flow, as described in, for example, Easy Traffic Simulation, Japan Society of Traffic Engineering, Maruzen Co., Ltd., June 2006, ISBN 4-905990-31-9C3051. The reference describes a traffic simulation technique that utilizes a block density method to predict the traffic congestion on highways.

In the microsimulation method, the behavior of each vehicle on a specific road is first simulated, the results of simulation are then accumulated for the respective time periods, and the traffic flow of the vehicles is reproduced on a road model, as described in, for example, Jpn. Pat. Appln. KOKAI Publication No. 2004-258889. This reference discloses a traffic simulator that uses molecular dynamics, which is usually applied in the fields of physics and material studies. The traffic simulator describes the influence each vehicle imposes on any nearby vehicle, as a potential hazard, and reproduces and displays the behavior of the vehicle.

In the macrosimulation method, the calculation load on the computer used is smaller than in the microsimulation method. In the microsimulation method, the calculation load on the computer is large because a calculation must be performed to simulate, as pointed out above, the behavior of each vehicle. The macrosimulation method, in which the calculation load on the computer is small, is now used in most cases to design a road network.

To design a road network for a broad area, it is necessary to predict traffic congestion, which more influences the traffic condition than anything else. Traffic congestion results from, in many cases, the drivers' lane changing at junctions or strange behavior of individual vehicles. The traffic simulator that performs the macrosimulation method defines the roads existing in each road-network section as links, and processes the traffic data (average value) averaged for each link. Further, the traffic simulator uses not only the average data for each link, but also the data actually acquired by a plurality of vehicle sensors provided along the roads, reproducing the traffic condition and predicting a traffic condition. The traffic simulator then displays the reproduced traffic condition and the predicted traffic condition on a display screen.

However, the traffic simulator performing the macrosimulation method cannot simulate the behavior of each vehicle or process the various aspects of behavior, to achieve microscopic reproduction of traffic congestion. Consequently, with any traffic simulator that performs the macrosimulation method it is not always easy to reproduce or predict traffic congestions.

BRIEF SUMMARY OF THE INVENTION

An object of this invention is to provide a system that can microscopically reproduce or predict the behavior of each vehicle running on a road, and can display the traffic condition, including congestion, in various modes on a display screen.

According to an aspect of this invention, there is provided a system in which a traffic simulator performs the microsimulation method, thereby reproducing or predicting a traffic condition on a road, and which has the function of microscopically displaying the simulation result in various modes on a display screen.

A system according to the aspect of the invention, which is designed to perform traffic simulation of a road network, comprises:

a traffic simulator configured to perform traffic simulation by a microsimulation method, to predict a traffic condition on an object road of the road network, by using road parameters defining the road network and model parameters used as initial-value parameters; and a display controller configured to control a display unit, displaying a dynamic image showing a traffic condition of vehicles running on the road network, on the screen of the display unit, as a result of the traffic simulation, which has been output from the traffic simulator, and changing the image displayed on the screen, in terms of pattern, in accordance with a display instruction.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described with reference to the accompanying drawings.

[Configuration of the System]

Figure 1:
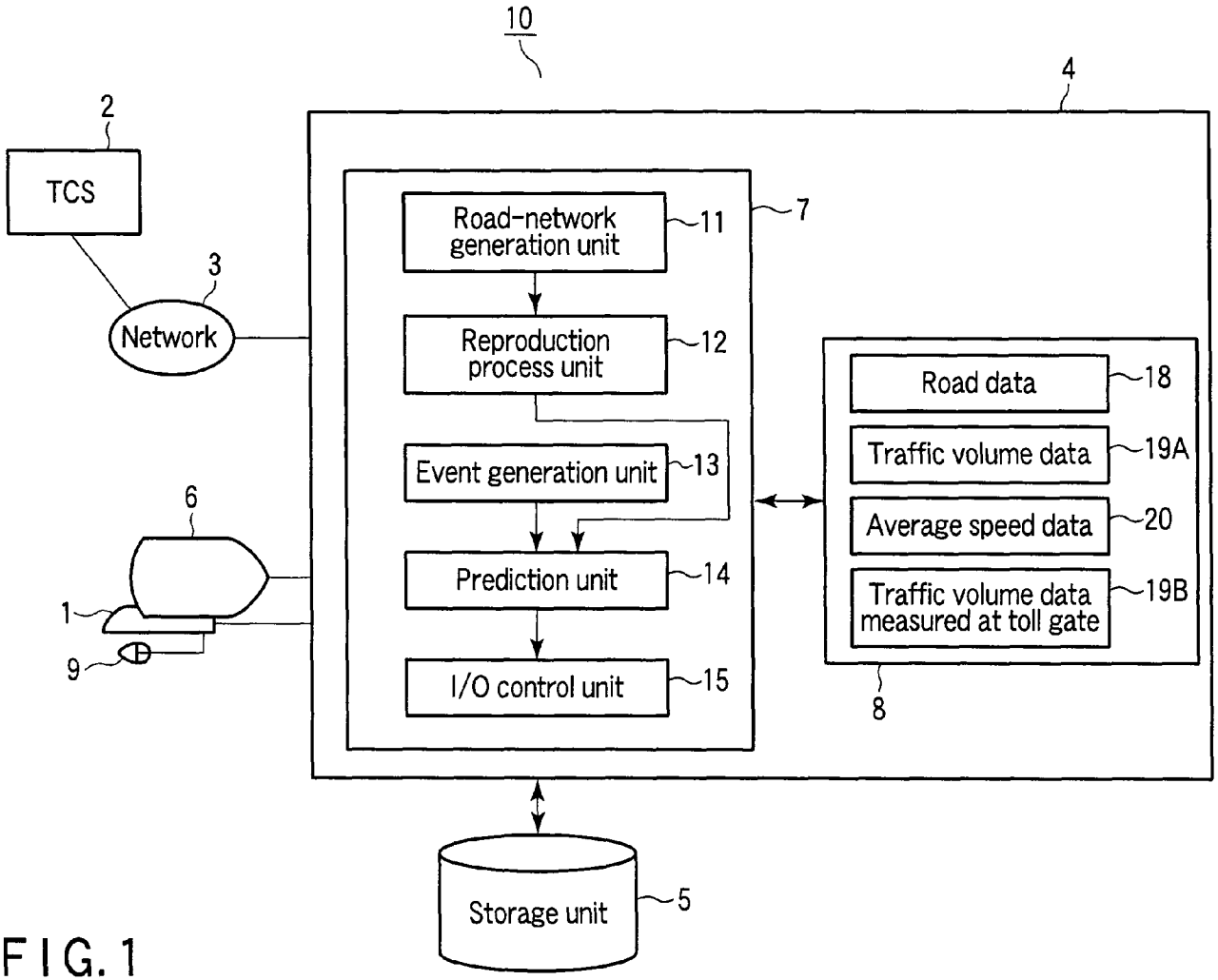
FIG. 1 is a block diagram explaining the configuration of a system according to an embodiment of this invention.

As shown in FIG. 1, a system 10 according to an embodiment of the invention has an input/output (I/O) unit 1, a traffic control system (TCS) 2, a network 3, a traffic simulator 4, and an external storage unit 5. The I/O unit 1 has an input unit and a display unit 6. The input unit is, for example, a keyboard or a mouse 9. The display unit 6 is an output unit and has a display screen. The external storage unit 5 includes, for example, a hard disk drive, and stores various programs and data, which the traffic simulator uses to perform its function.

The traffic control system 2 is a computer system owned by a road management company that manages ordinary roads and toll roads. The system 2 performs data communication with the traffic simulator 4 via the network 3. The traffic control system 2 controls road facilities such as traffic lights, toll receipt systems installed at toll gates, and the like, and various devices such as vehicle sensors (described later) installed along roads.

The traffic simulator 4 comprises a computer system and has, as major components, a central processing unit (CPU) 7 and an internal storage unit 8. The CPU 7 performs the functions of a road-network generation unit 11, reproduction process unit 12, event generation unit 13, prediction unit 14 and I/O control unit 15. As will be described later, the traffic simulator 4 is configured mainly to simulate the traffic condition of vehicles running on the road network (i.e., traffic flows and traffic congestion) and to output the simulation results to the display unit 6, thereby to display the simulation results on the screen of the display unit 6.

The road-network generation unit 11 uses, for example, the software called "road editor," generating road parameters (character data) representing the road network that the traffic simulator 4 will simulate. The road network includes the lanes of each road, new roads, branches and junctions. As seen from FIGS. 3A and 3B, the road parameters are redefined by road segments (RS), number of lanes, nodes (N) and links (L), etc.

Figure 3A:
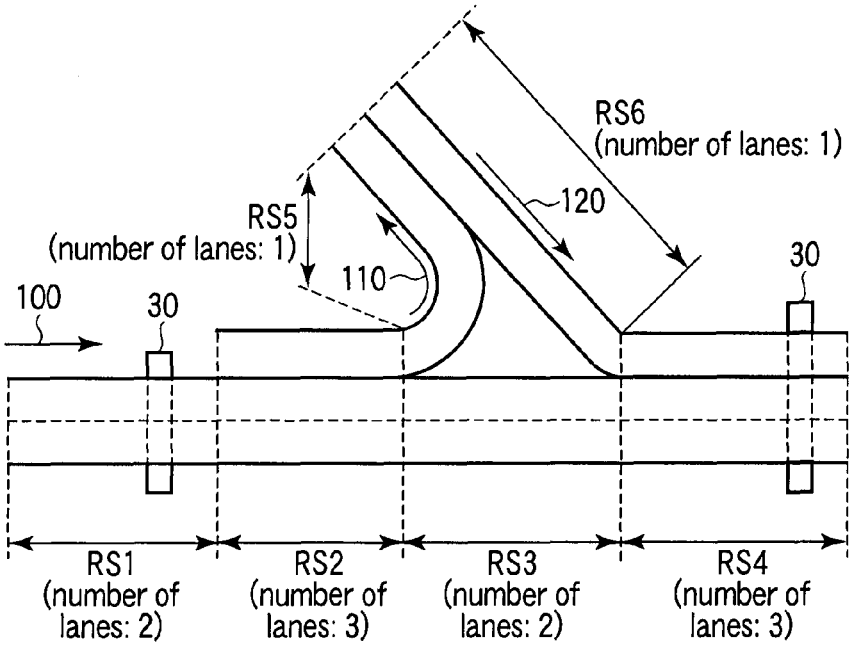
FIGS. 3A and 3B are diagrams explaining a road network according to the embodiment.

Any road segments RSn (n being a serial number) is one of the parts (shape elements) into which the road in question (hereinafter referred to as "object road") is divided in accordance with their shapes. The road exemplified in FIG. 3A is divided into six road segments RS1 to RS6. Each road segment is identified with a node (N) and a link (L). The node (N) is the end (link junction) of the road segment. The position of the node (N) is designated by a node number N1, N2, N3, N4 or N5 in the example of FIG. 3A. The link (L) indicates that part of the road that connects two adjacent nodes. The position of the link (L) is designated by the link number L1, L2, L3, L4, L5 or L6 in the example of FIG. 3A. The road-network generation unit 11 connects node numbers, link numbers and lane numbers, one to another, generating road parameters. The road parameters thus generated are stored, as road data 18, in the internal storage unit 8.

The reproduction process unit 12 reproduces the actual traffic condition (traffic flow and congestion) on the object road or a traffic condition similar to the actual traffic condition, from the road parameters (i.e., road data 18) generated by the road-network generation unit 11 and pertaining to the road network. At this point, the reproduction process unit 12 calculates the number of vehicles running on the road and the average speed of the vehicles, from the traffic amount and traffic density, both acquired from the traffic control system 2 through the network 3. Note that the traffic control system 2 has calculated the traffic amount and traffic density from the data acquired by the vehicle sensors (described later) installed along the object road.

The reproduction process unit 12 uses the number of vehicles and the average speed, performing simulation in which each vehicle is made to run at the average speed for a predetermined time. The reproduction process unit 12 acquires model parameters (initial-value parameters) by the simulation and stores the model parameters in the internal storage unit 8.

The event generation unit 13 performs the function of designating a specific position (i.e., object road) on the road network and a specified vehicle running on the object road, thereby generating, in the course of simulation, event data representing an event that hinders the road traffic, such as an engine trouble or a traffic accident.

The prediction unit 14 executes a simulation engine (software) designed for use in the microsimulation method described above, thus predicting the traffic condition (i.e., traffic flow and traffic congestion) on the object road, on the basis of the road parameters and the model parameters that are stored in the internal storage unit 8. More specifically, the prediction unit 14 uses the road parameters and the model parameters, performing simulation in which many vehicle models are made to run at a variable speed.

The prediction unit 14 first performs the simulation, sequentially calculating the positions of all vehicle models. The prediction unit 14 then writes the positions thus calculated into the external storage unit 5 in time sequence, thus predicting the traffic condition. More precisely, the prediction unit 14 designates a specific point on the road and a specific vehicle on the road, causing the event generation unit 13 to generate event data representing, for example, the engine trouble. From the event data, the prediction unit 14 calculates the data about all vehicles that have evaded traffic congestion, at predetermined time intervals (e.g., intervals of 1 second). Further, the prediction unit 14 calculates the data about vehicles that have been caught in traffic congestion. The data items thus acquired, each representing the number of a vehicle, the time of data acquisition, the position of the vehicle, are written in the external storage unit 5 in time sequence. The traffic condition is thereby predicted.

The I/O control unit 15 receives the result of prediction from the external storage unit 5, which the prediction unit 14 has acquired. The I/O control unit 15 then supplies the result of prediction to the display unit 6. The display unit 6 displays the prediction result on its screen, in such a pattern as will be described later. That is, the I/O control unit 15 receives, from the external storage unit 5, the data about the traffic condition predicted for the period from the present to a preset future time. The data received is supplied to the display unit 6, which displays the data on its screen.

[Operation of the System]

Figure 8:
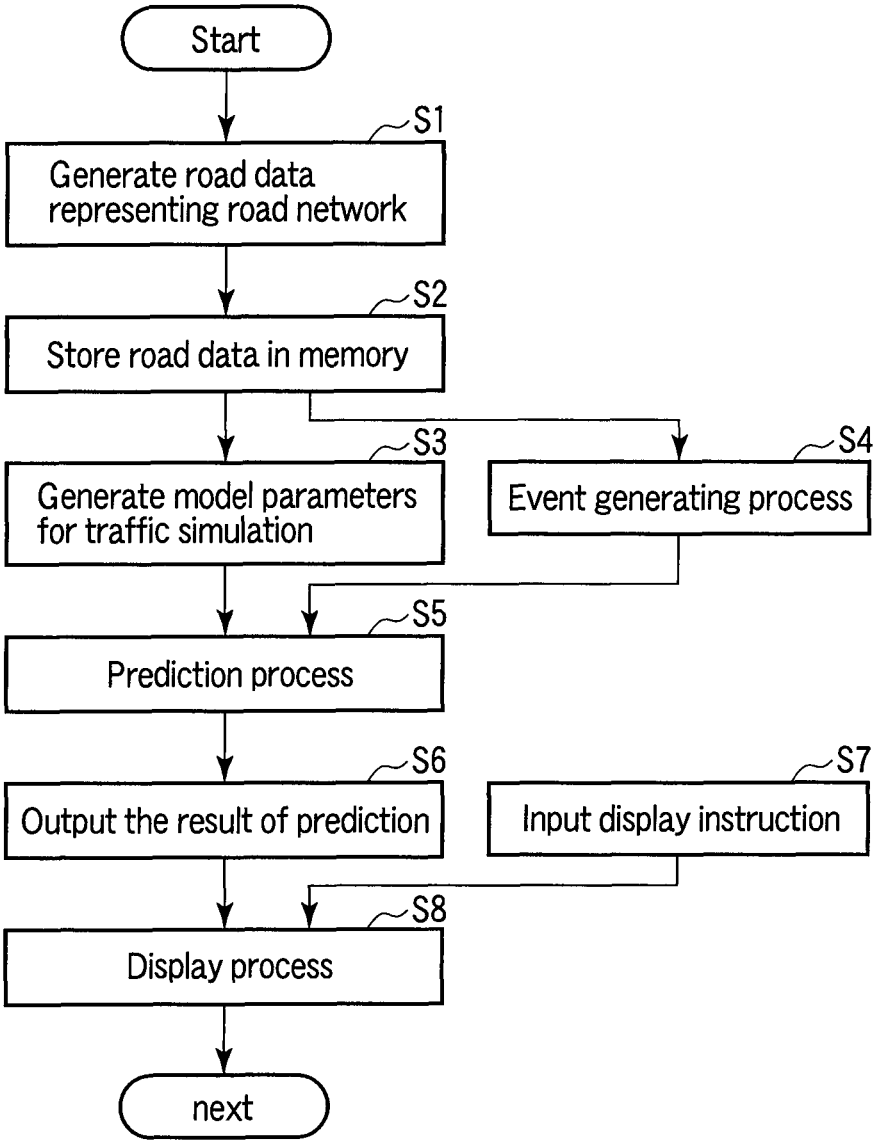
FIG. 8 is a flowchart explaining the operation of the system according to the embodiment.

How the system 10 according to this embodiment operates will be explained, mainly with reference to the flowchart of FIG. 8.

Figure 2:
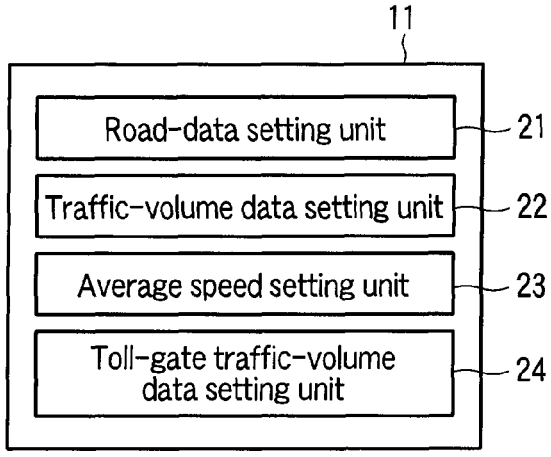
FIG. 2 is a block diagram explaining the function of a road-network generation unit according to the embodiment.

In the traffic simulator 4, the road-network generation unit 11 generates road parameters that represent the road network on which to perform the traffic simulation (Step S1). As shown in FIG. 2, the road-network generation unit 11 has four functions. More specifically, the unit 11 has a road-data setting unit 21, a traffic-volume data setting unit 22, an average speed setting unit 23, and a toll-gate traffic-volume data setting unit 24.

In accordance with the instruction coming from the above-mentioned road editor, the road-data setting unit 21 generates road data 18 when the input device of the I/O unit 1 is operated (Step S2). As seen from FIGS. 3A and 3B, the road data 18 is composed of road parameters, each including node (N), link (L) and number of lanes, etc. Thus, the road data 18 defines the road network including the object road.

FIG. 3A is a diagram for explaining the road segments RS1 to RS6 that are defined by the nodes (N) and the links (L). As FIG. 3A shows, a road network is assumed, which has a main road 100, a branch road 110 and a junction road 120. Along the main road 100, vehicle sensors 30 are provided at regular intervals in order to detect the vehicles running on the main road 100. The traffic control system 2 receives the result of detection, from the vehicle sensors 30. From the results of detection, the system 2 calculates the traffic volume and the traffic density. The traffic simulator 4 acquires the data representing the traffic volume and traffic density, from the traffic control system 2 through the network 3.

Figure 3B:
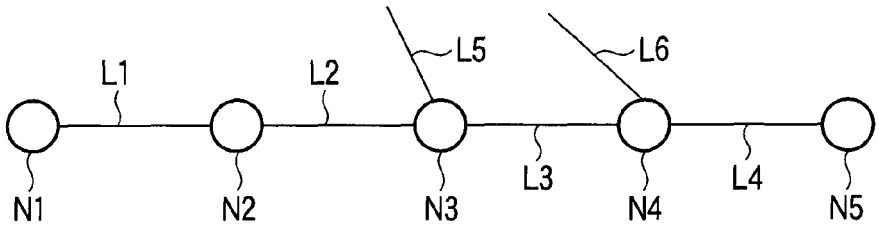

FIG. 3B is a diagram explaining the concept of nodes N1 to N5 and links L1 to L6 that define the road segments RS1 to RS6. As described above, the nodes N1 to N5 are the ends (link junctions) of the respective road segments. The links L1 to L6 are those parts of roads, each connecting two adjacent nodes. The road-data setting unit 21 generates, as road data 18, the position (coordinates) of each node, the connection of each link, the number of vehicles at each link, the inclination angle of each link (if the link is a slope), and the character road data representing the object road connected to a toll gate located at a node, if any, which is not connected to any other link. The road data 18 thus generated is stored in the internal storage unit 8.

The traffic-volume data setting unit 22, the average speed setting unit 23, and a toll-gate traffic-volume data setting unit 24 at the toll gate input traffic volume data 19A measured beforehand for the road, the average speed data 20 and the traffic volume data 19B measured at the toll gate and sets them in the internal storage unit 8. The traffic volume data 19A contains the data representing the number of vehicles running on the object road (more precisely, the number of vehicles per unit time). The traffic volume data 19B measured at the toll gate contains the data representing the number of vehicles per unit time, measured at the toll gate. The average speed data 20 represents the average speed of the vehicles running on the object road.

To be more specific, the traffic-volume data setting unit 22 is connected by the network 3 to the traffic control system 2 in accordance with an input from the input/output unit 1. Then, the unit 22 acquires the traffic-volume data items about the respective links from the traffic control system 2 in real time, and sets these traffic-volume data items in the internal storage unit 8. Alternatively, the traffic-volume data setting unit 22 may be configured to acquire vehicle passage data for each link, via the network 3 from the vehicle sensors 30 provided along the object road in accordance with an input from the input/output unit 1, and then to set the vehicle passage data in the internal storage unit 8.

Like the traffic-volume data setting unit 22, the average speed setting unit 23 is connected by the network 3 to the traffic control system 2 in accordance with an input from the input/output unit 1. Then, the average speed setting unit 23 acquires the average-speed data items about the respective links from the traffic control system 2 in real time, and sets these average-speed data items in the internal storage unit 8. Alternatively, the average speed setting unit 23 may be configured to acquire average speed data vehicle passage data for each link, from the vehicle sensors 30 provided along the object road and to set the vehicle passage data in the internal storage unit 8.

The toll-gate traffic-volume data setting unit 24 is connected by the network 3 to a system (not shown) installed at the toll gate to the toll road, in accordance with an input from the input/output unit 1. The setting unit 24 acquires the vehicle number data representing how many vehicles have passed through the toll gate within a predetermined time. From the vehicle number data, the setting unit 24 calculates the traffic volume at the toll gate. The data representing the traffic volume thus calculated is stored in the internal storage unit 8.

The road-network generation unit 11 thus acquires the road data (road parameters) defining the road network of the object road, the traffic volume data 19A about the links, the average speed data 20 about the links, and the traffic volume data 19B about the toll gate. The unit 11 then sets these data items 19A, 20 and 19B in the internal storage unit 8. The data items 19A, 20 and 19B (not the road data 18) will be called "traffic-related data," which has been obtained relatively recently in the traffic simulation.

Next, the reproduction process unit 12 uses the road data 18 and the traffic-related data, reproducing a road traffic condition (i.e., traffic flow and traffic congestion) that is similar to the actual traffic condition on the object road. The reproduction process unit 12 then acquires the model parameter of each vehicle running on the object road, or the model parameters of the traffic simulation (i.e., initial-value parameters), and sets the model parameters in the internal storage unit 8 (Step S3).

More specifically, the reproduction process unit 12 calculates the number of the vehicles running on the object road and the average speed of these vehicles, from the traffic volume and traffic density the unit 12 has acquired via the network 3 from the traffic control system 2 or the vehicle sensors 30.

Next, the reproduction process unit 12 uses the number of vehicles and the average speed of the vehicles, performing simulation in which each vehicle model is made to run at the average speed for a prescribed time. In the simulation, the reproduction process unit 12 performs optimization computation, utilizing, as functions, the vehicle parameters such as acceleration and braking, thereby calculating the model parameters (i.e., initial-value parameters). Further, the reproduction process unit 12 reproduces the traffic condition at regular intervals or at the same time on a specific day of every week, in the same way as described above, thereby calculating the model parameters. The unit 12 may adjust the model parameters in order to render the traffic condition similar to the actual traffic condition on the object road.

As described above, the reproduction process unit 12 stores the model parameters (i.e., initial-value data for simulation)

in the internal storage unit 8. The prediction unit 14 uses the model parameters in the traffic simulation to perform by the microsimulation method.

The prediction unit 14 predicts the traffic condition on the object road, from the road parameters (i.e., road data 18) and the model parameters stored in the internal storage unit 8 (Step S5). To be more specific, the prediction unit 14 uses the road parameters and the model parameters, performing traffic simulation in which many vehicle models are made to run at a predetermined speed. The number of the vehicle models used in the simulation is a number equivalent to the actual traffic volume on the object road, for example 100 vehicles.

While the many vehicles are running, the prediction unit 14 acquires data items at every predetermined time interval, such as the link number (including the car model), lane number, distance and position, which all pertain to each vehicle model, and stores these data items sequentially in the external storage unit 5 (Step S6). At this point, the prediction unit 14 designates a specific point on the road and a specified vehicle on the road. The event generation unit 13 generates event data representing, for example, the engine trouble (Step S4). From the event data, the prediction unit 14 acquires the position data about all vehicle models that have evaded traffic congestion, at predetermined time intervals (e.g., intervals of 1 second). The data items acquired, each of which represents the number of a vehicle, the time of data acquisition, the position of the vehicle, are written in the external storage unit 5 in time sequence. The traffic condition is thereby predicted.

Figure 4:
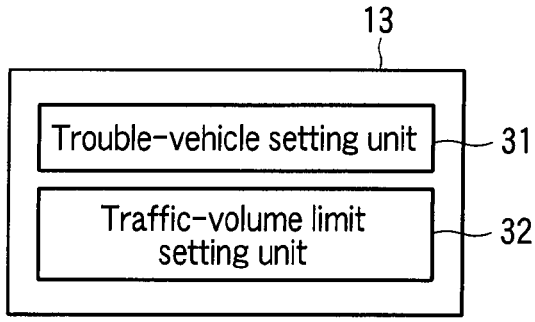
FIG. 4 is a block diagram explaining the function of an event generation unit according to the embodiment.

The event generation unit 13 generates event data in response to an input coming from the input unit and designating the specific point on the road and the specified vehicle on the road. The event data thus generated represents a trouble with any vehicle (such as the engine trouble), any traffic accident on the road, the toll gate closure due to traffic congestion, and the limitation to the number of vehicles allowed to pass through the toll gate. As shown in FIG. 4, the event generation unit 13 has a trouble-vehicle setting unit 31 and a traffic-volume limit setting unit 32.

The trouble-vehicle setting unit 31 generates the above-mentioned event data in accordance with the instruction coming from the input unit and stores the event data in the internal storage unit 8, after the reproduction process unit 12 has performed the traffic simulation on the object road identified with the road parameters. If the input unit designates a specific point on the road, the trouble-vehicle setting unit 31 will set an event mark to the specific point.

The traffic-volume limit setting unit 32 generates event data showing a limited traffic at the toll gate when a trouble develops in the specified vehicle. The unit 32 then stores the event data in the internal storage unit 8. To be more specific, in response to the instruction that comes from the input unit, the traffic-volume limit setting unit 32 designates the number of the link at which the trouble has occurred and the toll gate connected to a link adjacent to that link, upon lapse of a predetermined time after the trouble. Then, the traffic-volume limit setting unit 32 closes the toll gate for a predetermined time or limits the number of vehicles allowed to pass through the toll gate. If a trouble occurs in the specified vehicle, the event generation unit 13 will sets the number of the link and a traffic limit mark to the toll gate connected to the link adjacent to that link.

The prediction unit 14 predicts a traffic congestion that may occur when the event data is generated (that is, when a traffic accident occurs). At this point, the unit 14 predicts the traffic condition, by writing the results of calculation (i.e., the number of the vehicle, the time and the vehicle position data) into the external storage unit 5 in time sequence, as has been described above.

The unit 14 can therefore predict when the traffic congestion involving all vehicles running on the link will be eliminated in the future by executing a traffic simulation wherein the event data is generated in the state where the vehicles are assumed to run at the average speed calculated based on the traffic volume and traffic density at each link.

Figure 7:
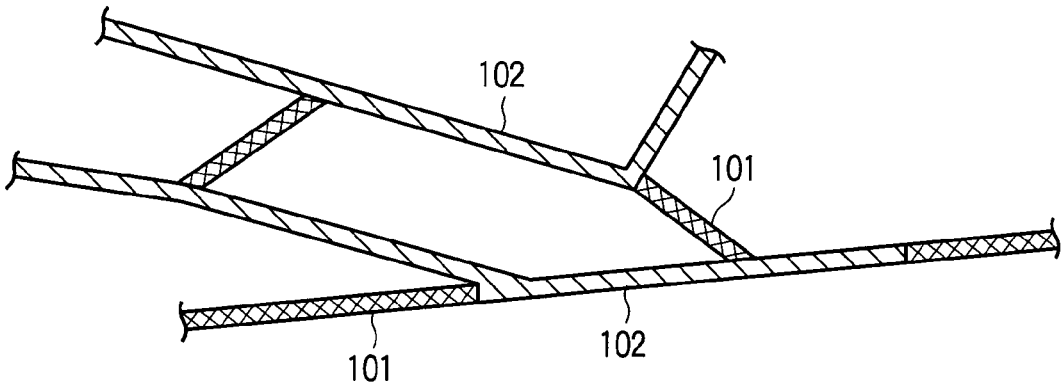
FIG. 7 is a diagram showing another exemplary result displayed on a screen, in the embodiment of the invention.

The I/O control unit 15 acquires the result of prediction generated by the prediction unit 14 from, for example the external storage unit 5. The prediction result, thus acquired, is displayed on the screen of the display unit 6 (Step S8). On the basis of the prediction result (i.e., prediction data), the I/O control unit 15 may cause the display unit 6 to display the network of the object road as is illustrated in FIG. 7. The exemplary network of FIG. 7 is composed of links 101 and links 102. At the links 101, traffic congestion is occurring. At the links 102, normal traffic flows are achieved. On the screen of the display unit 6, the links 101 are displayed, for example, in red, while the links 102 are displayed, for example, in yellow.

[Display Control in the Traffic Simulator]

How the I/O control unit 15 controls the display in the traffic simulator 4 according to this embodiment will be explained below in detail.

Figure 5:
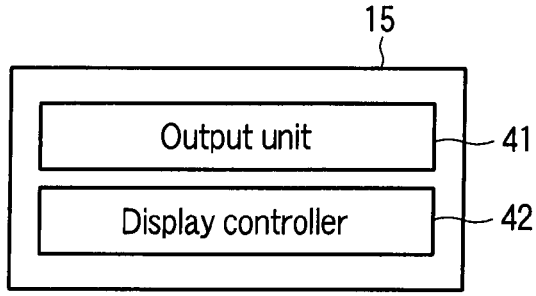
FIG. 5 is a block diagram explaining an input/output control unit according to the embodiment.

In this embodiment, the I/O control unit 15 has the function of controlling the display of the predicted (simulated) traffic condition (traffic flow and traffic congestion) on the network of the object road, in accordance with the display operation made at the I/O unit 1 (Steps S7 and S8). As FIG. 5 shows, the I/O control unit 15 has an output unit 41 and a display controller 42. The output unit 41 is configured to output the result of prediction. The output unit 41 is configured to control the displaying of the result of prediction.

The output unit 41 acquires the prediction data from the external storage unit 5. That is, the unit 41 reads various data items such as the vehicle numbers, link numbers, lane numbers, travel distances from start points, time, and vehicle positions, and supplies these data items to the display unit 6 and a printer (not shown).

Figure 9:
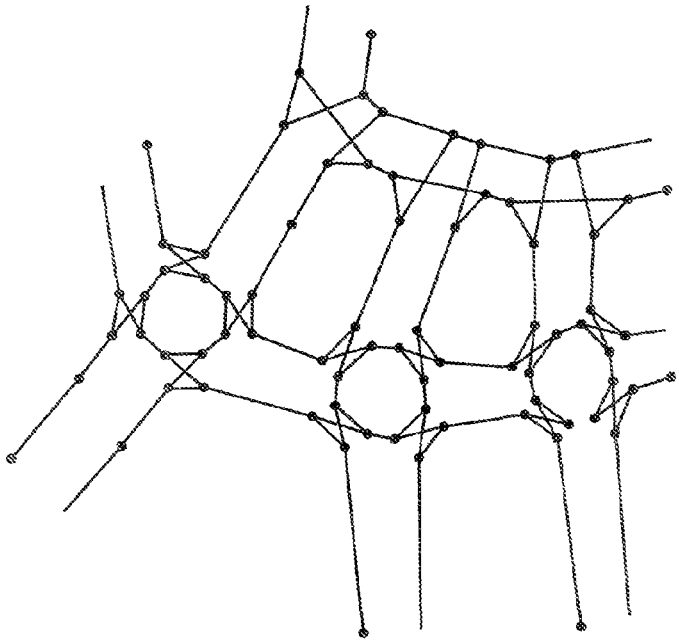
FIG. 9 is a diagram showing an image of a road network, generated by the embodiment.
Figure 10:
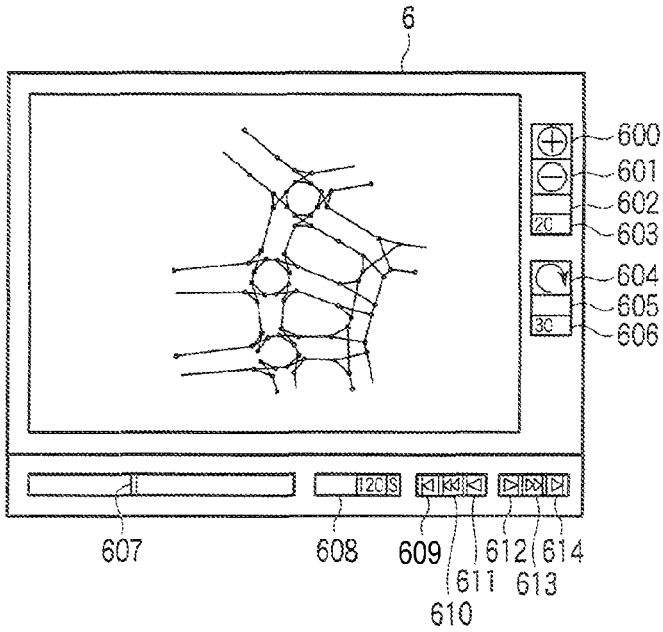
FIG. 10 is a diagram showing a method of displaying images on the display screen in the embodiment.

The display controller 42 controls the display unit 6 in accordance with the road parameters (road data 18) the road-network generation unit 11 has generated. So controlled, the display unit 6 displays a network image of the object road on its screen as illustrated in FIG. 10. Note that FIG. 9 is a diagram that shows the image of the road network defined by road parameters of nodes and links.

Figure 6:
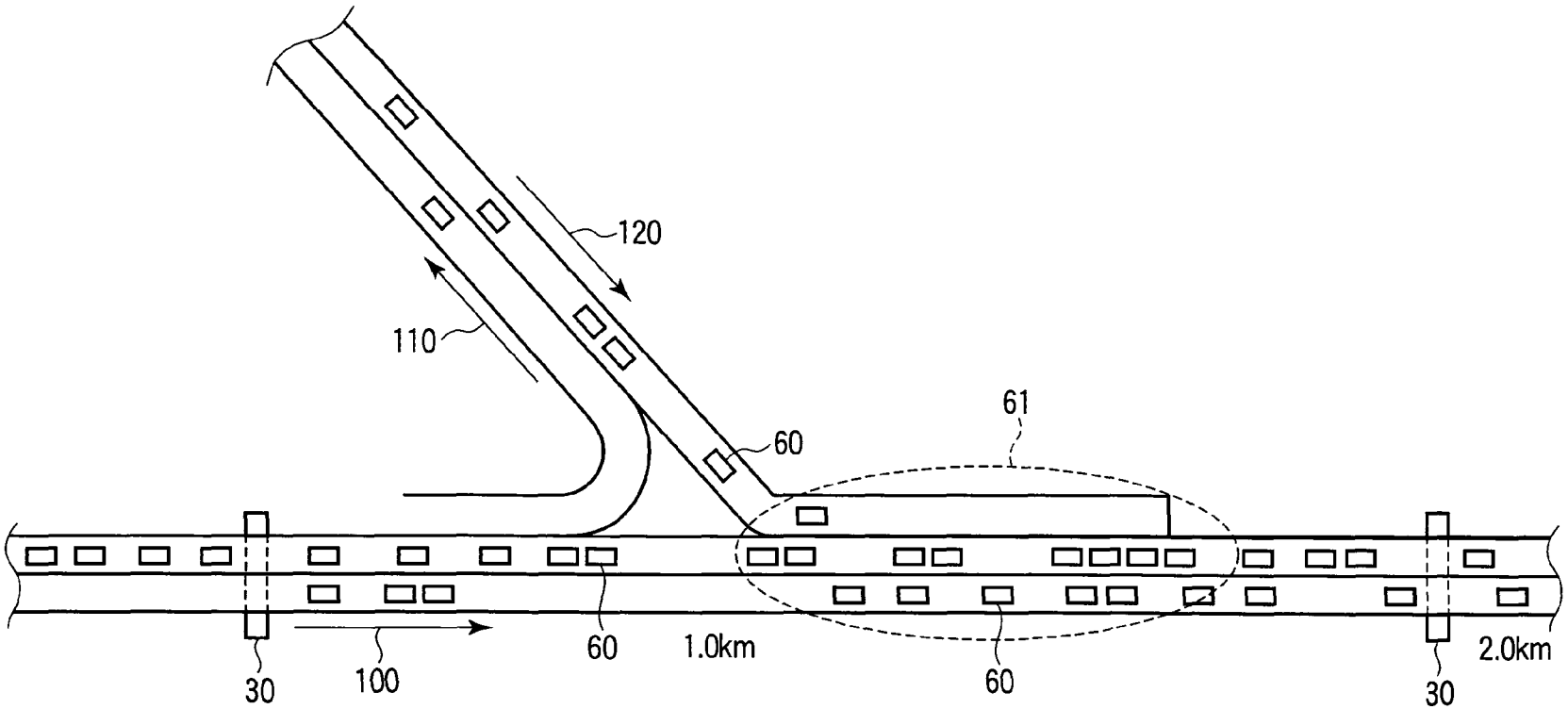
FIG. 6 is a diagram showing an exemplary result displayed on a screen, in the embodiment of the invention.

The display controller 42 uses the various data items output from the output unit 41, causing the display unit 6 to display, on its screen, the traffic condition predicted for the network of the object road, i.e., the images of all vehicles changed in position from time to time. That is, as shown in FIG. 6, the display controller 42 displays the behaviors (changes) the vehicles 60 take on the road, in a still-picture image or moving-picture image. The image of FIG. 6 shows how the vehicles 60 are running on the main load 100, branch road 110 and junction road 120 of the object road. As seen from FIG. 6, some of the vehicles 60 are caught in traffic congestion at the section 61 where the junction road 120 meets the main road 100. Seeing the image thus displayed by the traffic simulator 4, the person in charge of designing roads can plan to build a by-pass extending parallel to that section, in order to prevent such congestion as shown in FIG. 6.

The display controller 42 has the function of causing the display unit 6 to display such an image as shown in FIG. 10. As shown in FIG. 10, this image shows buttons 600 to 605, a window 606, a slider 607, a window 608 and buttons 609 to 614. The window 608 shows the time. How the display control unit 6 operates will be explained in detail, with reference to FIG. 10 and FIGS. 11A to 11G and FIG. 12A to 12C.

First, the display controller 42 causes the display unit 6 to display an animation (moving picture) that is the result of simulation (i.e., result of prediction) (see FIG. 6), in accordance with the operation of the buttons 609 to 614 that are related to the playback of time-serial data. More precisely, the display controller 42 performs a playback process when the playback button 612 is pushed, a fast-feed process when the fast-feed button 613 is pushed, and a complete fast-feed process when the complete fast-feed button 614 is pushed. The fast-feed button 613 has the function of feeding the data, for example, at a speed twice the ordinary speed, at a speed four times the ordinary speed, or at a max speed eight times the ordinary speed when it is repeatedly pushed.

The "playback process" is a process of sequentially reproducing the time-serial data (i.e., vehicle position data) that is the result of prediction. The "fast-playback process" is a process of displaying time-serial data at a speed higher than the ordinary speed.

Further, the display controller 42 performs a rewind process when the rewind button 611 is pushed, a fast-rewind process when the fast-rewind button 612 is pushed, and a complete rewind process when the complete rewind button 609 is pushed. The fast-feed button 610 has the function of rewinding the data at a speed twice the ordinary speed, at a speed four times the ordinary speed when it is repeatedly pushed. The "rewind process" is a process of playing back the time-serial data at the ordinary speed in the reverse direction.

Moreover, the display controller 42 controls the display unit 6 when the slider 607 is operated, and causes the display unit 6 to display for a short time that part of the simulation result, which has been predicted for a specified time, in the form of an animation (moving picture). In this case, the time displayed in the window 608 changes as the slider 607 is moved. The slider 607 can be moved by operating the mouse 9.

The display controller 42 performs a magnification process, a reduction process and a rotation process on a designed part of the image (i.e., simulation result), when the magnification button 600, reduction button 601 and rotation button 604 are pushed. When operated, the button 602 sets the value by which to magnify the image every time the magnification button is pushed, and to reduce the image every time the reduction button 601 is pushed. When operated, the button 605 sets a rotation angle (degrees). The angle set by operating the button 605 is displayed in the window 606.

The magnification process and the reduction process will be explained in detail, with reference to FIG. 11A to 11G.

Figure 11A:
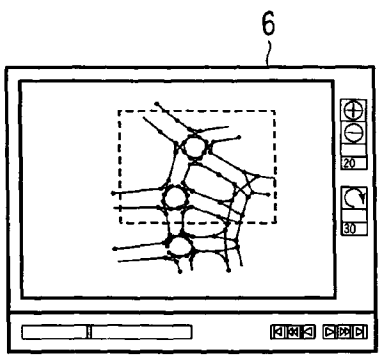
FIGS. 11A to 11G are diagrams explaining an exemplary method of displaying images in the embodiment.

As shown in FIG. 11A, the display controller 42 selects a region (broken-line frame) of the prediction-result image displayed on the screen of the display unit 6. This region has been designated by operating the mouse 9. When the magnification button 600 is pushed as sown in FIG. 11B, the display controller 42 performs the magnification process, causing the display unit 6 to magnify the selected region, for example 20 times the original size, as shown in FIG. 11C. The magnification button 600 may be further pushed while the magnified image is being displayed as shown in FIG. 11C. Then, the display controller 42 controls the display unit 6, which displays the image further magnified as shown in FIG. 11G. The magnification button 600 may be pushed even further (see FIG. 11). In this case, the display controller 42 causes the display unit 6 to display the image magnified as shown in FIG. 11E, so that the traffic congestion may be recognized as occurring on the designated road on the road network.

Figure 11B:
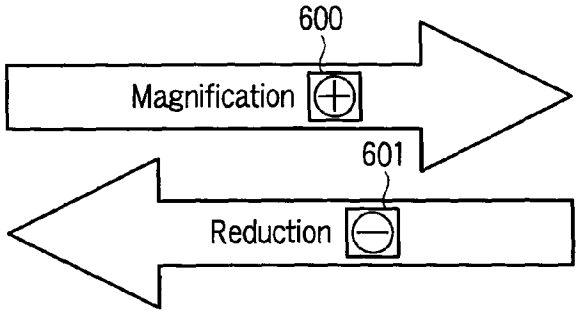
Figure 11C:
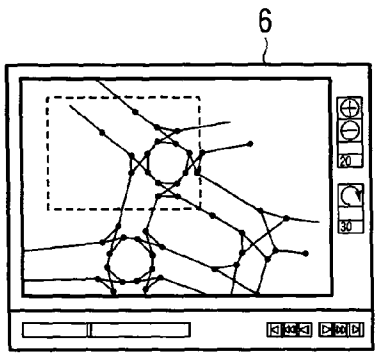
Figure 11D:
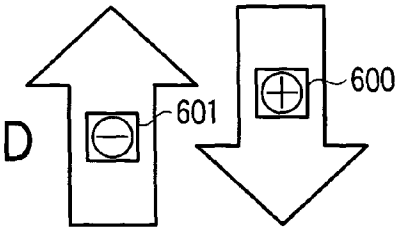
Figure 11F:
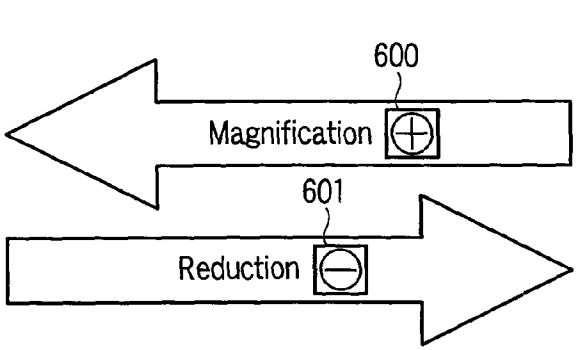
Figure 11E:
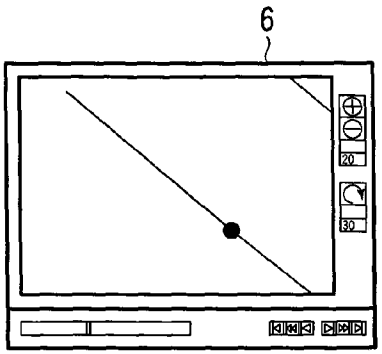
Figure 11G:
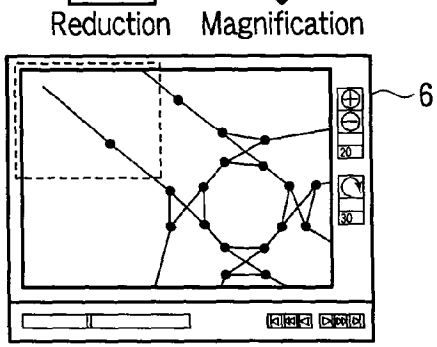

On the other hand, the reduction button 601 may be pushed as illustrated in FIGS. 11F, 11D and 11B. If this is the case, the display controller 42 controls the display unit 6, reducing the image from the size shown in FIG. 11G, to the size shown in FIG. 11C, and further to the size shown in FIG. 11A.

Figures 12A, 12B, 12C:
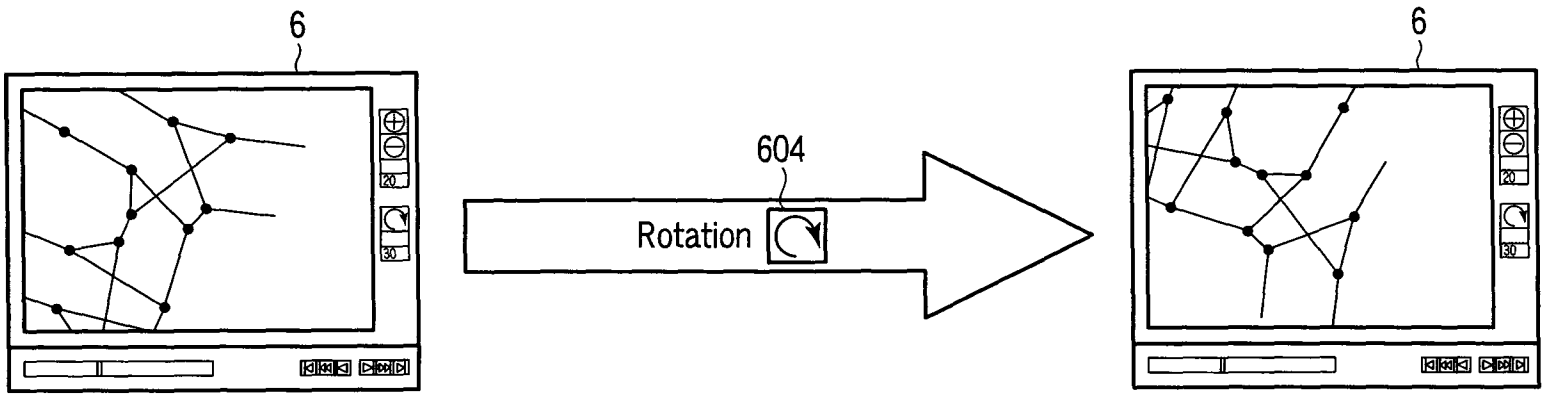
FIGS. 12A to 12C are diagrams explaining another exemplary method of displaying images in the embodiment.

FIGS. 12A to 12C are diagrams explaining an exemplary rotation process. When the rotation button 604 is operated as shown in FIG. 12B, the display controller 42 performs the rotation process, rotating an image shown in FIG. 12A clockwise by 90°, to such a position as shown in FIG. 12C. Note that the display controller 42 has another function of performing a 3D rotation process to rotate a 3D image, by first determining an origin for the road image data and vehicle image data and then moving the apices of the 3D image around the origin thus determined.

Furthermore, the display controller 42 can cause the display unit 6 to display, on its screen, not only the data representing the above-mentioned prediction result, but also the traffic volume data, acquired from the vehicle sensors 30 in the past, the average speed data about the vehicles at each link, and similar data, all acquired from the vehicle sensors 30 in the past.

Configured as described above, the system according to this embodiment can perform the microsimulation method. The system can therefore achieve traffic simulation based on the road parameters and model parameters (i.e., initial-value parameters) that define a road network. The system can thus microscopically predict a traffic condition (i.e., traffic flow and traffic congestion) on any object road. In the system, the display unit 6 can display, on its screen, the result of simulation, i.e., the microscopically predicted behavior of each vehicle running on the object road.

In this case, the system according to this embodiment performs the ordinary reproduction process, the reproduction process on the time axis (including sliding process and fast-feed process), and the various display processes including a magnification process, a reduction process and a rotation process. Performing these processes, the system can display the result of simulation in various patterns on the screen of the display unit 6. In other words, the system can display the traffic condition (including traffic congestion) on the object road in various patterns. The manager of the traffic control system 2 and the person in charge of designing roads can therefore easily understand the predicted traffic condition on the object road.

The system according to this embodiment can easily predict a traffic congestion on the object road, which may result from the trouble in a vehicle on the road or from a traffic accident on the road, and an unusual traffic condition on a toll road, which may result from the closing of a toll gate or the limitation to the number of vehicles allowed to pass through the toll gate. Hence, the system enables those concerned to make decisions to moderate or prevent the traffic congestion, within a shorter time than before.

Other Embodiment

Figure 13:
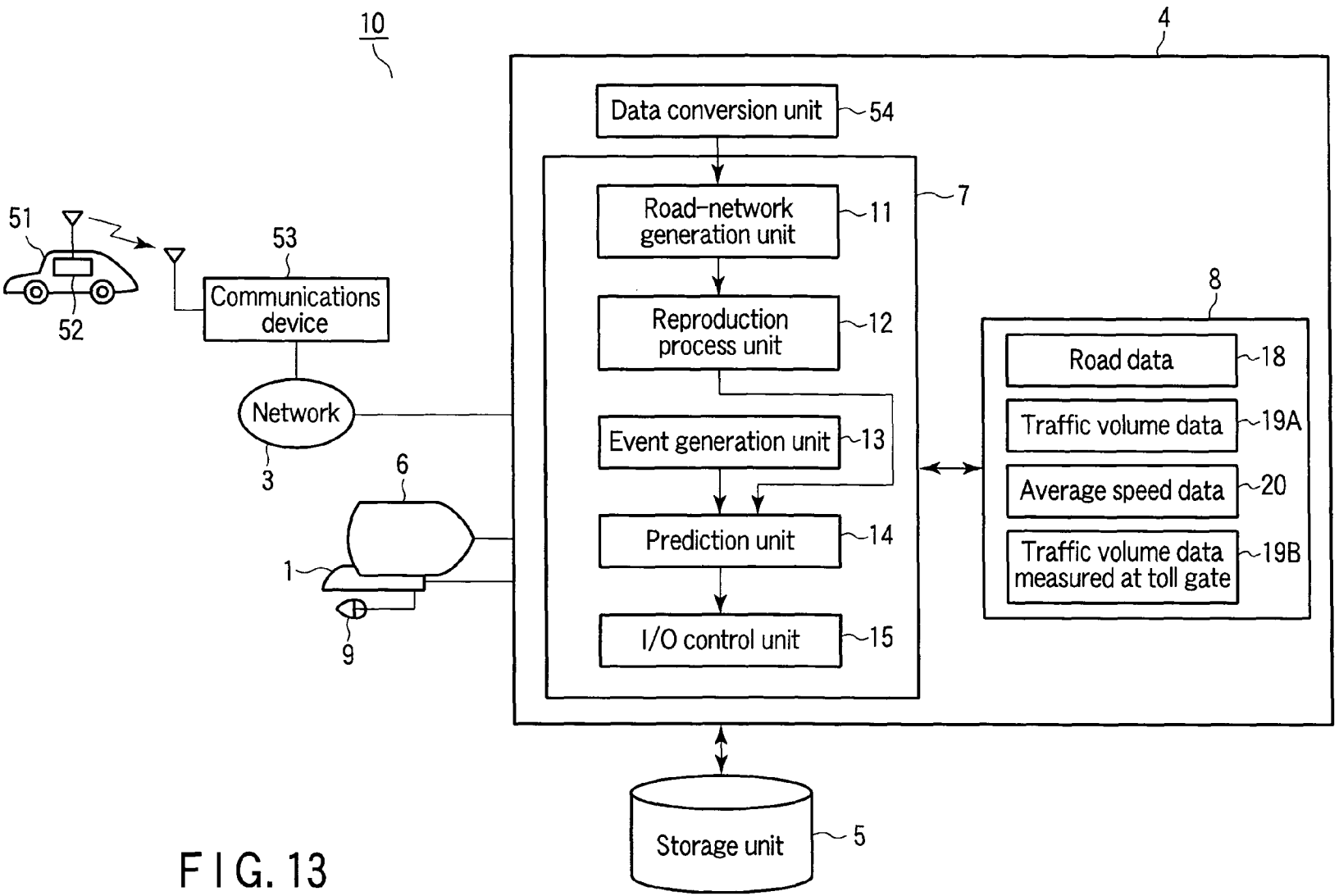
FIG. 13 is a block diagram explaining the configuration of a system according to another embodiment of the present invention.

FIG. 13 is a block diagram that shows the configuration of a system 10 according to another embodiment of this invention.

This system 10 has a configuration including a vehicle-mounted device 52, a communications device 53, and a data conversion unit 54. The vehicle-mounted device 52 is mounted in a vehicle 51. The communications device 53 is configured to perform communication with the vehicle-mounted device 52. The system 10 is identical to the system of FIG. 1 in any other structure aspect, and will not be described in detail.

The vehicle-mounted device 52 includes a wireless communications unit, an intra-vehicle sensor, a storage unit, and a controller. The wireless communications unit is configured to transmit the data about the vehicle 51 (hereinafter called "vehicle data"). The controller causes the wireless communications unit to transmit, by radio, the data stored in the storage unit to the communications device 53. The data represents the model of the vehicle 51 and the data measured by the intra-vehicle sensor. The intra-vehicle sensor measures the time the vehicle 51 has run on each road segment and the average speed of the vehicle 51, and outputs the data items representing the time and the average speed, respectively, to the controller.

The communications device 53 is installed, for example, on one side of the road. The device 53 collects the data items transmitted from the vehicle-mounted device 52 provided in each vehicle 15 running on the road and transmits these data items to the traffic simulator 4 via the network 3. The communications device 53 is a dedicated short-range communications (DSRC) device and performs wireless communication that is either radio or optical communication.

The data conversion unit 54 is a component incorporated in the traffic simulator 4 and implemented by a computer system. The data conversion unit 54 receives the vehicle data from the communications device 53 and converts this data to traffic-related data, which will be used in the traffic simulation the traffic simulator 4 performs. The data conversion unit 54 supplies the traffic-related data to the road-network generation unit 11. The road-network generation unit 11 performs the above-mentioned process on the traffic-related data. Alternatively, the unit 11 may receive the vehicle data from the data conversion unit 54 and may store this data in the internal storage unit 8, without processing the data at all.

The system according to this embodiment can perform, in sequence, the processes related to the traffic simulation, thereby achieving the same advantages as the system of FIG. 1. Moreover, the system according to this embodiment can acquire, from each vehicle, the vehicle data that represents the behavior of the vehicle actually running on any road. Performing traffic simulation using the data about the vehicles actually running on the road, the traffic simulator 4 can predict traffic congestion on the road at high accuracy.

In addition, the traffic simulator 4 can use the data actually acquired from the vehicles, simulating the behavior of each vehicle. The system 10 can therefore help to verify traffic accidents on the basis of the data acquired immediately after the accidents.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A system for traffic simulation of a road network, comprising:

a traffic simulator having at least one processor configured to perform traffic simulation by a microsimulation method, to predict a traffic condition on an object road of the road network, by using road parameters defining the road network and model parameters being initial-value parameters; and;

a display controller configured to control a display unit to perform functions including;

displaying a dynamic image showing a traffic condition of vehicles running on the road network, on the screen of the display unit, as a result of the traffic simulation, which has been output from the traffic simulator, and changing the image displayed on the screen, in terms of pattern, in accordance with a display instruction, wherein:

the traffic simulator includes:

a reproduction process unit configured to calculate the model parameters based on a simulation in which each vehicle model is made to run on the object road;

an event generation unit having a trouble-vehicle setting unit and a traffic-volume limit setting unit configured to designate a specific point on the road and a specific vehicle on the road and generate event data representing an event that causes traffic congestion on the object road, the event being a trouble with any vehicle and an traffic accident on the object road; and a prediction unit configured to perform traffic simulation in which a number of vehicle models are made to run on the object road of the road network, using the road parameters and the model parameters, and to calculate, as the result of the traffic simulation, time-serial data for predicting the behavior of each vehicle model, the time-serial data containing position data representing the positions of all vehicle models in the traffic congestion at predetermined time interval based on the event data; and the display controller uses the time-serial data in accordance with a reproduction instruction, causing the display unit to display an animation in which the vehicle models change position on the road network over time.

2. The system according to claim 1, wherein the display controller performs a fast-feed process or a rewind process on the displayed animation in accordance with a fast-feed instruction or a rewind instruction.

3. The system according to claim 1, wherein the display controller changes the animation being reproduced at present to an animation reproduced at any designated time, in accordance with a slider instruction.

4. The system according to claim 1, wherein the display controller performs, in accordance with a display instruction, a magnification process, a reduction process or a rotation process on an image displayed in a designated region of the screen.

5. The system according to claim 1, wherein the traffic simulator includes a road-network generation unit configured to generate the road parameters including nodes, links and lane numbers that define road segments.

6. The system according to claim 1, further comprising a communications unit configured to collect, via a network, the data representing traffic conditions on the actual roads of the road network.

7. The system according to claim 6, further comprising a data conversion unit configured to convert the data collected by the communications unit, to data that can be used in the traffic simulation performed by the traffic simulator.

8. The system according to claim 6, wherein the communications unit performs wireless communication with a vehicle-mounted device provided in each vehicle running on an actual road, thereby to collect data representing the traffic condition and containing vehicle data transmitted from the vehicle-mounted device, the vehicle data containing time data representing the time and average speed for and at which any vehicle runs on each road segment.

9. A method of performing traffic simulation of a road, designed for use in traffic simulation, the method comprising:

acquiring road parameters defining the road network and model parameters being initial value parameters;

using the road parameters and the model parameters, thereby performing traffic simulation by a microsimulation method, to predict a traffic condition on an object road of the road network, by using a road parameter defining the road network and model parameters used as initial-value parameters;

displaying a dynamic image showing a traffic condition of vehicles running on the road network, on the screen of a display unit, as a result of the traffic simulation; and changing the image displayed on the screen, in terms of pattern, in accordance with a display instruction, wherein the performing traffic simulation performs:

traffic simulation in which a number of vehicle models are made to run on the object road of the road network, using the road parameters and the model parameters, and includes a reproduction process of calculating the model parameters based on a simulation in which each vehicle model is made to run on the object road, an event generation process of designating a specific point on the road and a specific vehicle on the road and generating event data presenting an event that causes traffic congestion on the object road at predetermined time interval, using a network generation unit having a trouble-vehicle setting unit and a traffic-volume limit setting unit, the event being a trouble with any vehicle and an traffic accident on the object road; and a prediction step of calculating, as the result of the traffic simulation, time-serial data for predicting the behavior of each vehicle model, the time-serial data containing position data representing the positions of all vehicle models in the traffic congestion based on the event data, and the displaying uses the time-serial data in accordance with a reproduction instruction, causing the display unit to display an animation in which the vehicle models change position on the road network over time.

* * * * *

UNITED STATES PATENT AND TRADEMARK OFFICE

CERTIFICATE OF CORRECTION

PATENT NO. : 8,532,965 B2
APPLICATION NO. : 12/509025
DATED : September 10, 2013
INVENTOR(S) : Hirata et al.

It is certified that error appears in the above-identified patent and that said Letters Patent is hereby corrected as shown below:

In the Claims

Claim 1, column 12, line 2, change “including;” to --including:--.

Claim 1, column 12, line 8, change “instruction,” to --instruction;--.

Signed and Sealed this
Fifth Day of November, 2013

Teresa Stanek Rea
*Deputy Director of the United States Patent and Trademark Office*